US012648597B2

(12) United States Patent
Wyrick

(10) Patent No.: US 12,648,597 B2
(45) **Date of Patent: *Jun. 9, 2026**

(54) POST-OPERATION MASTECTOMY RECOVERY GARMENT

(71) Applicant: Three Strands Recovery Wear Corporation, Salisbury, NC (US)

(72) Inventor: Leah Brooke Wyrick, Salisbury, NC (US)

(73) Assignee: Three Strands Recovery Wear Corporation, Salisbury, NC (US)

( * ) Notice: Subject to any disclaimer, the term of this patent is extended or adjusted under 35 U.S.C. 154(b) by 0 days.

This patent is subject to a terminal disclaimer.

(21) Appl. No.: 19/019,860

(22) Filed: Jan. 14, 2025

(65) Prior Publication Data

US 2025/0295182 A1 Sep. 25, 2025

Related U.S. Application Data

(63) Continuation of application No. 18/611,500, filed on Mar. 20, 2024, now Pat. No. 12,225,948.

(51) Int. Cl.
*A41C 3/00* (2006.01)
*A41C 3/12* (2006.01)

(52) U.S. Cl.
CPC ..... *A41C 3/0064* (2013.01); *A41C 3/12* (2013.01)

(58) Field of Classification Search
CPC ..... A41C 3/00064; A41C 3/12
See application file for complete search history.

(56) References Cited

U.S. PATENT DOCUMENTS 2,389,410 A * 11/1945 Butow ..... A41F 1/04 450/142
4,630,610 A 12/1986 Fletcher
5,257,956 A 11/1993 Ewen
6,055,668 A * 5/2000 Gros ..... A41D 13/1245 2/69

(Continued)

FOREIGN PATENT DOCUMENTS

GB 90052387970001 12/2018

OTHER PUBLICATIONS

U.S. Appl. No. 17/381,878, Non-Final Office Action, filed Sep. 21, 2023, 17 pages.

(Continued)

*Primary Examiner* — Gloria M Hale
(74) *Attorney, Agent, or Firm* — Kilpatrick Townsend & Stockton LLP

(57) ABSTRACT

Described herein is a wearable garment for recovery of a wearer after the wearer has undergone a surgical procedure, the wearable garment having an outer shell including at least a back panel and two front panels that, when the wearable garment is worn about a wearer, have outer edges that are adjacent to each other, a fastening system configured to secure the outer edges of the front panels together, wherein the fastening system comprises a hook and eye mechanism and a zipper, thereby securing the wearable garment about the wearer, a compression region that provides a compressive force about the wearer; straps that hold the wearable garment about the wearer, and a drain loop strap attached to each of the front panels for holding a drain tube in a coiled configuration against the wearer.

20 Claims, 7 Drawing Sheets

(56) References Cited

U.S. PATENT DOCUMENTS

| | | | | |
|---|---|---|---|---|
| 6,477,710 | B1 | 11/2002 | Ojoyeyi | |
| 8,696,403 | B2 | 4/2014 | Haley | |
| 9,161,574 | B2 | 10/2015 | Swendseid et al. | |
| D744,718 | S | 12/2015 | Randall | |
| 11,058,159 | B2 | 7/2021 | Stephens et al. | |
| 11,058,189 | B2 * | 7/2021 | Steiner | A44C 5/00 |
| D995,982 | S | 8/2023 | Wang | |
| 11,771,146 | B2 | 10/2023 | O'Neill | |
| 12,097,318 | B2 * | 9/2024 | Wyrick | A41C 3/148 |
| D1,060,936 | S | 2/2025 | Swendseid | |
| 12,225,948 | B1 * | 2/2025 | Wyrick | A41C 3/12 |
| D1,073,251 | S | 5/2025 | Xu | |
| 2006/0019576 | A1 | 1/2006 | Bell et al. | |
| 2006/0194509 | A1 | 8/2006 | Patterson | |
| 2008/0294128 | A1 | 11/2008 | Richards | |
| 2011/0195634 | A1 | 8/2011 | Flesch | |
| 2013/0254970 | A1 | 10/2013 | Curran et al. | |
| 2014/0196189 | A1 | 7/2014 | Lee et al. | |
| 2015/0099420 | A1 * | 4/2015 | Reinhard | A41C 3/02 450/58 |
| 2016/0066624 | A1 * | 3/2016 | Blackwell | A41C 3/02 450/58 |
| 2017/0135847 | A1 * | 5/2017 | Leibowitz | A61F 5/4408 |
| 2018/0332905 | A1 | 11/2018 | Stephens et al. | |
| 2018/0338551 | A1 | 11/2018 | Stephens et al. | |
| 2018/0360133 | A1 | 12/2018 | Blackwell | |
| 2020/0077718 | A1 * | 3/2020 | Thompson | A41D 13/1281 |
| 2020/0107588 | A1 | 4/2020 | Smith | |
| 2022/0095703 | A1 | 3/2022 | Razdan et al. | |
| 2022/0257404 | A1 | 8/2022 | Brown et al. | |
| 2023/0189901 | A1 | 6/2023 | Liotus | |

OTHER PUBLICATIONS

U.S. Appl. No. 17/381,878, Notice of Allowance, filed Apr. 24, 2024, 11 pages.

U.S. Appl. No. 18/611,500, Corrected Notice of Allowability, filed Jan. 14, 2025, 2 pages.

U.S. Appl. No. 18/611,500, Non-Final Office Action, filed Jun. 21, 2024, 10 pages.

U.S. Appl. No. 18/611,500, Notice of Allowance, filed Oct. 16, 2024, 5 pages.

U.S. Appl. No. 29/933,628, "Non-Final Office Action," Apr. 23, 2026, 10 pages.

* cited by examiner

POST-OPERATION MASTECTOMY RECOVERY GARMENT

CROSS-REFERENCE TO RELATED APPLICATION

The present application is a Continuation of U.S. patent application Ser. No. 18/611,500, filed Mar. 20, 2024, which issued as U.S. Pat. No. 12,225,948 on Feb. 18, 2025, the entirety of which is hereby incorporated by reference.

FIELD OF INVENTION

The subject matter disclosed herein generally relates to post-operative garments useful in aiding in the recovery of patients after having undergone one or more surgical procedures. More particularly, the subject matter disclosed herein relates to a post-operative mastectomy bra that will aid in the recovery of patients after surgery of single or double mastectomies, breast reconstructions, breast augmentations, breast lifts, breast reductions, and the like.

BACKGROUND

One in eight women will be diagnosed with breast cancer over the course of her lifetime in the United States. As healthcare services will always be needed by patients for the diagnosis and treatment of breast cancer, new advancements are made continuously in the search for a cure for breast cancer. However, a lack of advancements in post operation medical support devices for patients having a mastectomy on one or both breasts has left a major gap in the reconstructive industry. Currently known mastectomy bras lack needed functionality that can reduce the risk of complications and provide a more comfortable recovery for patients during recovery from surgery. For example, many mastectomy bras have neither adjustable bands to provide variable compression to the patient and/or the ability to securely manage tubing that is secured within the chest cavity of a post-operative patient for fluid drainage. As such, a need currently exists to address these and other disadvantages prevalent in other currently known post-operative mastectomy bras.

SUMMARY

This specification discloses embodiments of wearable garments for recovery of a wearer after the wearer has undergone a surgical procedure. An example of a wearable garment can comprise:

A wearable garment for recovery of a wearer after the wearer has undergone a surgical procedure, the wearable garment comprising: a back panel and two front panels that, when the wearable garment is worn about a wearer; a fastening system configured to secure the outer edges of the two front panels together, wherein the fastening system comprises a hook-and-eye mechanism and a zipper, thereby securing the wearable garment about the wearer; a compression band configured to provide a compressive force about the wearer; and a drain loop strap attached to each of the two front panels for holding a drain tube against the wearer.

In some cases, an example of a wearable garment for recovery of a wearer after the wearer has undergone a surgical procedure, the wearable garment comprising: a back panel and two front panels that wherein the outer edges of the front panels are adjacent to each other when the wearable garment is work about a wearer; a fastening system configured to secure the outer edges of the front panels together, thereby securing the wearable garment about the wearer; a removable compression band configured to provide a compressive force about the wearer and comprising:

elastomeric material, wherein the compression band secures at bottom of the back panel through a fabric insertion point at either end of the back panel; and an attachment flaps at either end of the compression band; and wherein the attachment flaps are configured such that, when pulled towards the front panels of the wearable garment, the attachments plans connect to corresponding attachment surfaces at the bottom of each front panel, wherein the compression band can be variably stretched thereby increasing or decreasing a magnitude of the compression force provided at the compression region; straps configured to hold the wearable garment about the shoulders of the wearer; a drain loop strap for holding a drain tube in a coiled configuration against the wearer; and a drain pocket configured to hold at least one drainage device connected to a first end of the drain tube, wherein the drainage device is configured to suction fluid from a surgical site of the wearer through the drain tube.

DETAILED DESCRIPTION

This specification discloses example embodiments of a wearable post-operative garment in the form of a recovery garment, generally designated 100, which in some non-limiting embodiments is suitable for aiding in post-operative recovery of patients after surgical removal of one or both breasts, for example, as a result of a diagnosis of breast cancer.

Figure 1:
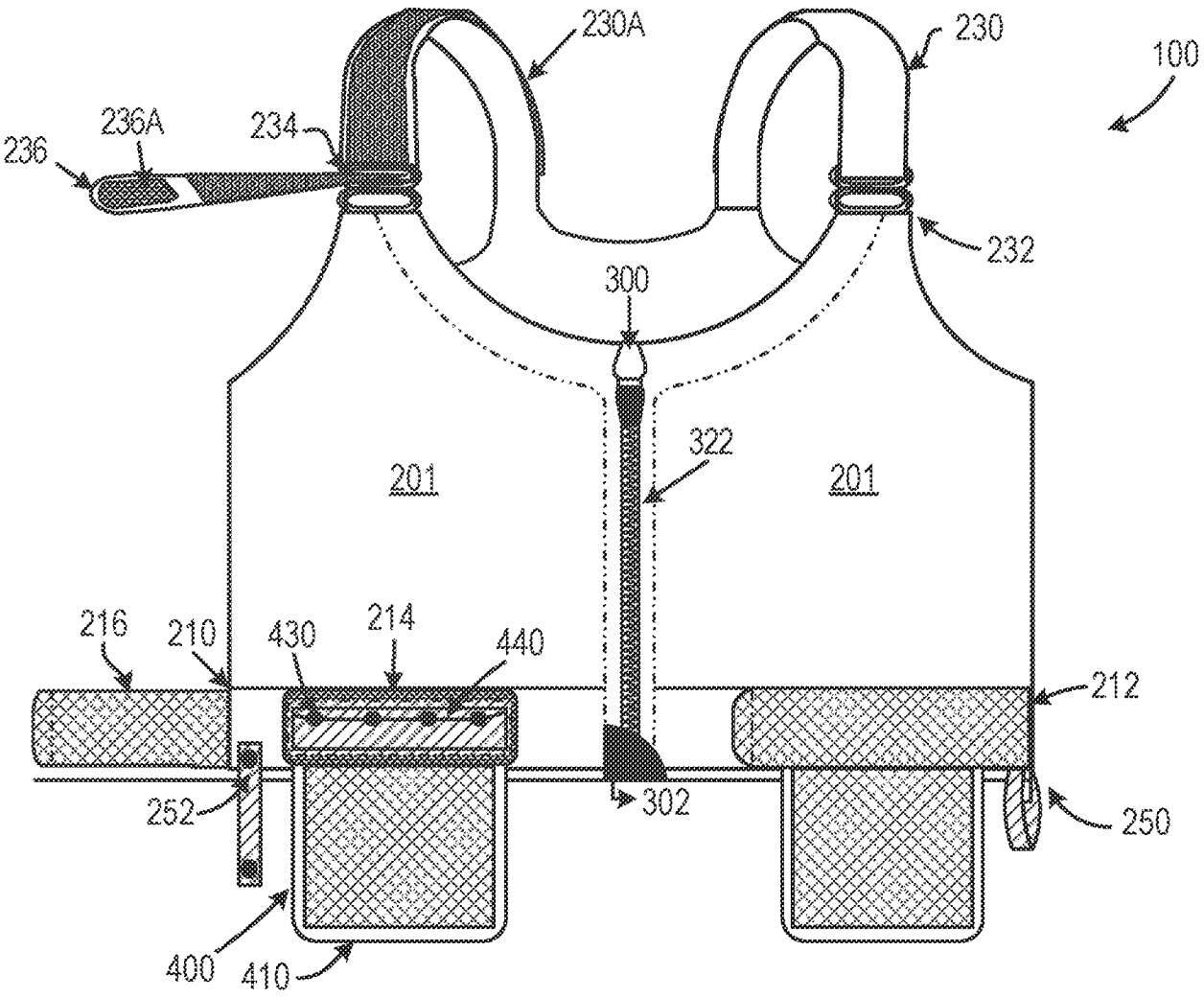
FIG. 1 is a front view of an example embodiment of a recovery garment (e.g., a bra) suitable for use, for example, in patients having undergone a mastectomy procedure.

FIG. 1 is a front view of the recovery garment 100 having two front panels 201 that are joined together at edges that are adjacent to each other on the front view of the garment (i.e., FIG. 1) by fastening system 300. The recovery garment 100 is otherwise a continuous piece of fabric. For clarity, the back view of the garment shows a back panel 202 in FIGS. 2-5. The front panels 201 and the back panel 202 are assembled together from a single piece of fabric, such that the resulting recovery garment 100 will be devoid of any seams that may cause user discomfort when the recovery garment 100 is worn for an extended period of time. It is advantageous for the fabric used in their construction of the recovery garment 100 to be a suitable stretchy fabric, e.g., a fabric having some elastomeric fibers woven therein, that will cause a compressive force to be generated against the skin of the wearer to prevent unwanted shifting and fluid accumulation of the skin at locations where the surgery was performed, which can lead to post-operative pain, lymphedema, and increased risk of infection.

The recovery garment 100 front panels 201 and back panel 202 extend all the way down making the top of the recovery garment 100 and the bottom of the recovery garment 100 one continuous piece of fabric. The recovery garment 100, comprises a compression insertion gap, generally designated 210, at a lower edge of the recovery garment 100. At the compression insertion gap 210, the recovery garment 100 has a removable compression band 212 inserted through the insertion gap 210, which extends from one side of the back panel 202 to the other side of the back panel 202 and which attaches on each front panel 201 with compression towards the fastening system 300, such that the compression band 212 extends entirely around the recovery garment 100, including across the width of both front panels 201 and also across the back panel 202. In some embodiments, the compression band 212 is not removable and is sewn to the back panel 202. It is advantageous for the compression band 212 to be made from a stretchable material, e.g., a material having an elastomeric fiber component woven therein. In some embodiments, the compression band 212 may be configured to be stretched by at least 25% of the unstretched length when worn by the wearer to generate a compressive force on the torso of the wearer. In other embodiments, the compression band 212 may be configured to be stretched by at least 10, 15, 20, 25, 30, 35, 40, or 45% of the unstretched length when worn by the wearer to generate a compressive force on the torso of the wearer.

In some embodiments, the compression band 212 serves to provide auxiliary compression to the torso of the wearer. As such, in the embodiment shown, the compression band 212 has two attachment surfaces 214, which can be made of "loop fabric" or "hook fabric" in the manner of hook-and-loop fabric (e.g., of the kind marketed under the trade name Velcro®), the attachment surfaces 214 being attached, e.g., sewn, onto an outer surface of both front panels 201. The compression band 212 also has at least two corresponding attachment flaps 216, which can be made of whichever of the "loop fabric" or the "hook fabric" the attachment surfaces 214 are not made from, attached at a predetermined position on the compression band 212, such that a portion of the attachment flaps 216 is secured to the attachment surfaces 214 and the attachment flaps 216 can be stretched as part of the compression band 212, and wherein the compression band 212 can be moved freely relative to the back panel such that the free portion of the attachment flaps 216 can extend about the back panel 202 without disrupting the continuity of the fabric.

When the recovery garment 100 is configured to be worn about the torso of a wearer, the wearer of the recovery garment, or a person aiding the wearer of the recovery garment 100, as the case may be, may grasp the free portion of the compression band 212, the attachment flaps 216, and pull the attachment flaps 216 towards the attachment surfaces 214 so that at least a portion of the attachment flaps 216 can be secured to the attachment surfaces 214 where the attachment flaps 216 overlaps the attachment surfaces 214. This pulling of the attachment flaps 216 towards the attachment surfaces 214 stretches the compression band 212 wherein the attachment flaps 216 are attached thereto, by tightening the garment around the torso of the wearer when the attachment flaps are connected to the attachment surfaces 214, thereby effectively shortening the distance between the ends of the compression band 212, the attachment flaps 216, by connecting at the attachment surfaces 214 on the front panels 201 of the recovery garment 100.

It is this stretching of the compression band 212 that allows the recovery garment 100 to be able to provide a variable amount of compression to the wearer at the of the bottom end of the recovery garment 100. As such, the amount of compression provided by the compression band 212 can be altered by stretching the compression band 212 to attach at the attachment flaps 216 at different points on attachment surfaces 214 affixed to the front panels 201 of the recovery garment 100. This is advantageous because, during the post-operative healing process, as swelling decreases, the recovery garment 100 can begin to fit more loosely than it should. As such, the degree by which the compression band 212 needs to be stretched in the days and weeks post-surgery can increase as the swelling at the surgical site abates. Additionally, while the recovery garment 100 will need to be manufactured in different sizes to be fitted about the torsos of wearers having various sizes, the ability to vary the effective length of the compression band 212 allows for the number of sizes in which the recovery garment 100 must be manufactured to be minimized and/or reduced.

In some embodiments, the compression band 212 may have 2, 4, 6, or 8 attachment flaps 216 and corresponding attachment surfaces 214 affixed on the front panels 201 of the recovery garment 100. In the embodiment shown in FIGS. 1-3, there are two attachment flaps 216 and attachment surfaces 214 attached substantially symmetrically about the compression band 212 or the front panels 201, respectively. For example, relative to the torso of the wearer.

Figure 2:
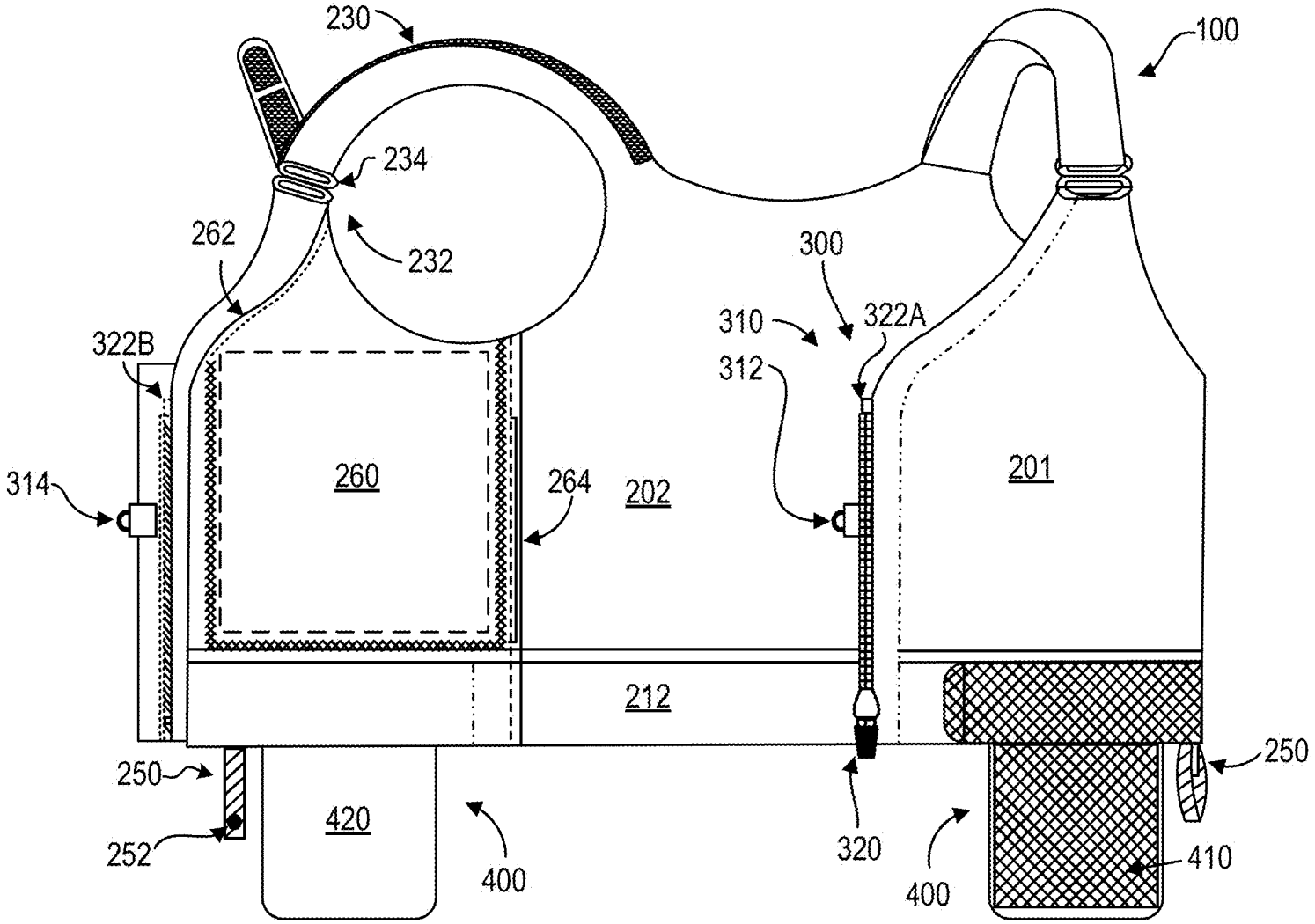
FIG. 2 is a partial internal view of the garment shown in FIG. 1, showing internal components associated therewith.
Figure 3:
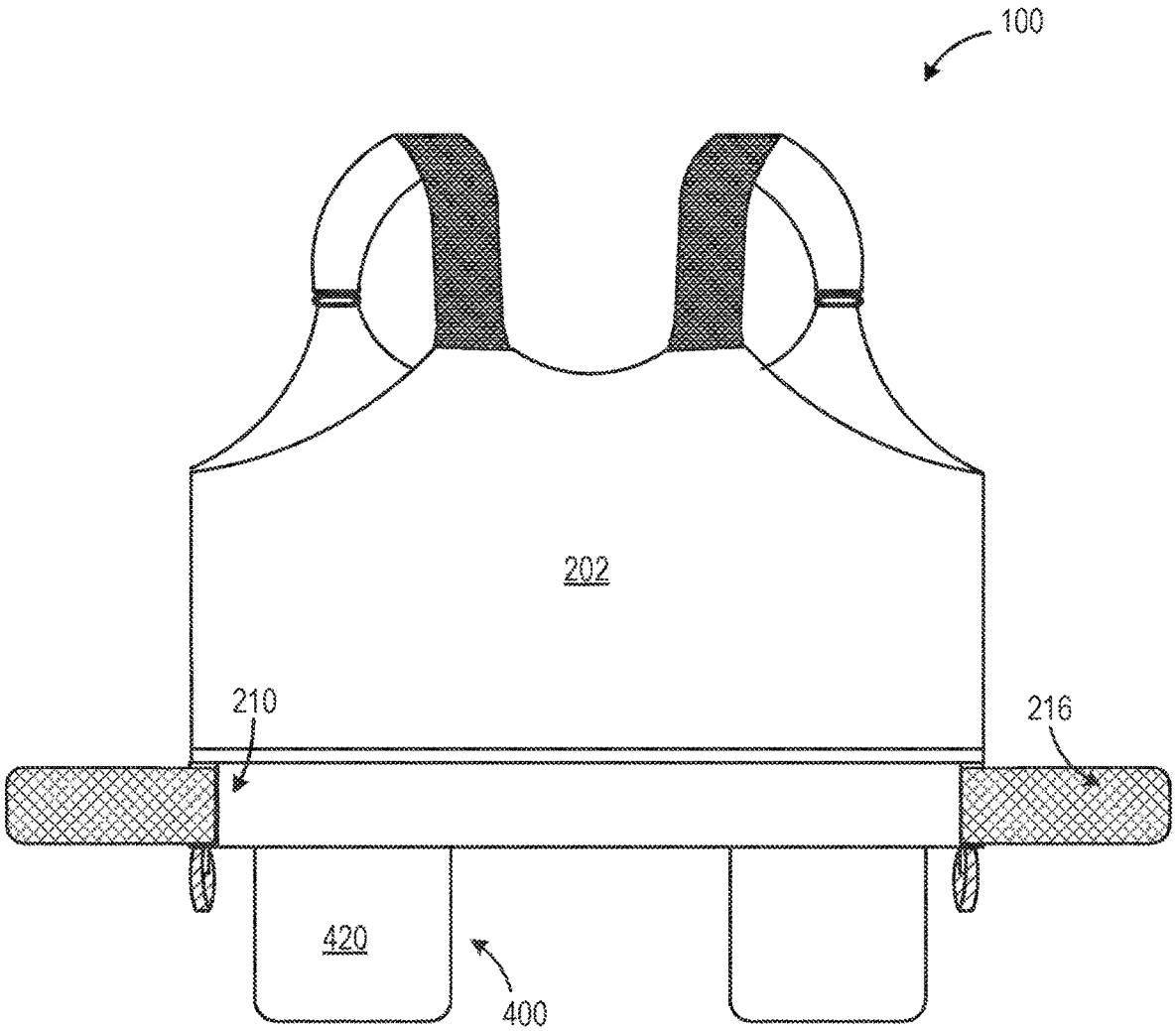
FIG. 3 is a rear view of the garment shown in FIG. 1.
Figure 4:
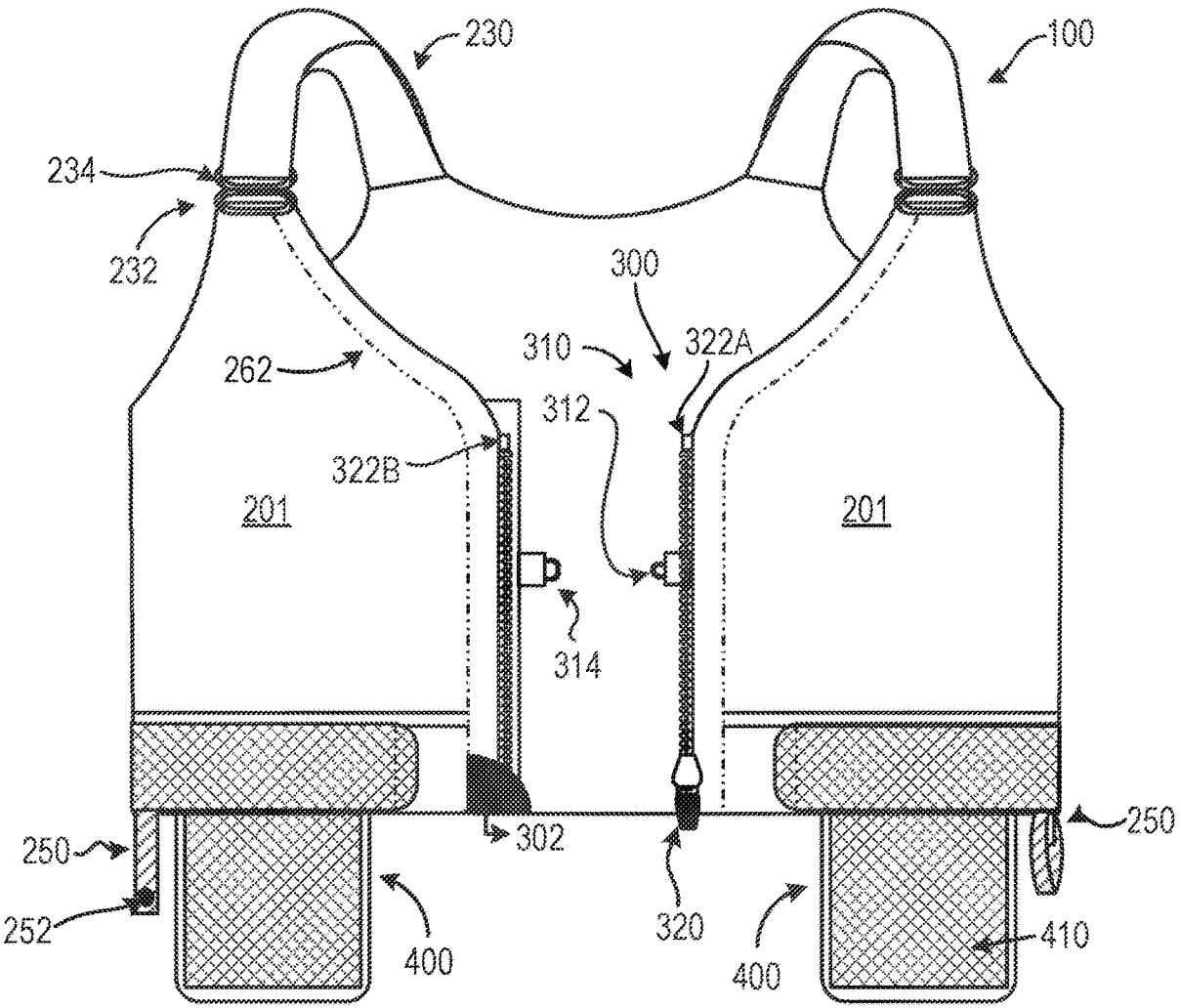
FIG. 4 is a partial internal view of the garment shown in FIG. 1, showing further aspects of the garment.

The installation positions of the attachment flaps 216 and the attachment surfaces 214 may be interchanged, such that the attachment flaps 216 are rigidly connected along its length on a portion of the front panels 201 and the attachment surfaces 214 are connected to a portion of the compression band 212 without deviating from the subject matter disclosed herein. While it is contemplated that the placements of the attachment flaps 216 and the attachment surfaces 214 may be reversed, such that the attachment surfaces 214 are attached in the same manner as is shown in FIGS. 1-3 but on a portion of the compression band 212 and the attachment flaps 216 may be attached in the same manner as is shown in FIGS. 1-3 but on a portion of the front panels 201, the illustrated configuration may be advantageous for durability of the materials. In some embodiments, the reverse attachment may also be advantageous. The illustrated configuration allows for the recovery garment 100 to be readily fitted about the torso of the wearer immediately after the surgical procedure and before the wearer has been removed from the surgical environment. In some embodiments, the attachment flaps 216 may be replaced with, for example, an elastic strap with hooks attached thereto and the attachment surfaces 214 may be replaced with, for example, sequential rows of eyes with which the hooks of the elastic strap may be engaged to effectively shorten the length of the compression band 212 and provide a desired amount of compression about the torso of the wearer. Other types of suitable mechanisms to shorten the effective length of the compression band 212 will be understood by those having ordinary skill in the art and do not deviate from the scope of the subject matter disclosed herein.

The recovery garment 100 also has detachable straps from the front panels 201, generally designated 230, which extend continuously from an upper point of each shoulder of the back panel 202 to an upper point on each of the front panels 201, such that the straps 230 are able to pass over each shoulder of the wearer in the same manner as a shoulder strap. In the embodiment shown in FIG. 1, the straps 230 do not cross each other and are made of the same continuous fabric extending from the back panel 202. The straps 230 are removably attached to the front panel 201 at loops 234 which serve as passages to the ends of the front-side of the straps 236. The front-side of each strap 236 has an attachment surface 236A, which can be made of "loop fabric" or "hook fabric" in the manner of hook-and-loop fabric (e.g., of the kind marketed under the trade name Velcro®), the attachment surfaces 236A being attached, e.g., sewn, onto an outer surface of the front-side of each strap 236. The attachment surfaces 236A on the front-side of each strap 236 can attach to the corresponding attachment point 230A which can be made of "loop fabric" or "hook fabric" in the manner of hook-and-loop fabric (e.g., of the kind marketed under the trade name Velcro®) and which extends the length of the strap 230. The loops 234 are attached to the recovery garment 100 front panels 201 at attachment points 232. The attachment points 232 can be in the form of looped fabric extending from the front panels 201 and securing the loops 234 in place. The straps 230 are made of the same material as the recovery garment 100 and extend continuously from the back panel 202. In order to minimize the number of lengths of straps that must be provided, the straps 230 can be tightened by pulling the front-side of the straps 236 through the loops 234 attached at the front panels 201 and connecting the attachment surfaces 236A with the strap attachment points 230A.

The loops 234 may be made from any suitable material, including, for example, a polymer (e.g., plastics), a metal, or a metal alloy. It is advantageous for the attachment point 232 on the front panel 201 where the loops 234 are attached to be located near the collar bone, e.g., clavicle, of the wearer when the recovery garment 100 is being worn. This placement of the attachment point 232 near the collar bone allows for an easily accessible way of detaching the strap from the front panel 201 while the recovery garment 100 is still being worn. As such, by detaching the strap 230 from one of the front panels 201, the upper part of that front panel 201 can be pulled down to allow for inspection of the surgical site, whether by the user or otherwise by a trained medical professional to ensure that proper healing is occurring without requiring removal of the recovery garment 100, which can cause further trauma to the wearer at the surgical site during removal of the recovery garment 100.

As noted herein, maintaining compression around the torso of the wearer at the surgical sites is important in reducing the risk of infection, for example, due to fluid accumulation post-surgery. Since the recovery garment 100 can provide a variable amount of compression to the wearer at the surgical sites based on the stage of recovery at which the wearer is, the amount of fluid within the wearer at the surgical site(s) can be minimized, which thereby decreases the risk of infection. To ensure the recovery garment 100 is installed to be sufficiently tight around the torso of the wearer, and also remains sufficiently tight to provide a therapeutically beneficial amount of compression at the surgical site(s), the recovery garment 100 has a fastening system, generally designated 300, which has what is referred to herein as a double layer of compression where the recovery garment 100 is secured about the torso of the patient by a hook 312 and eye 314 system as well as by a zipper 322.

As noted above, the fastening system 300 includes a single hook-and-eye attachment (312 and 314, respectively) and a zipper, generally designated 322. At the bottom of the fastening system 300 is a fabric overlay 302 (FIG. 1) to cover the bottom of the zipper 320 (FIG. 2) to reduce rubbing of the skin or irritation that may be caused by skin contact with the bottom of the zipper 320. In an embodiment, the zipper 322 may be a sports zipper. The hook-and-eye attachment (312 and 314, respectively) has a single eye 314 attached to one of the front panels 201 of the recovery garment 100. A single hook 312 is attached to the other of the front panels 201. The vertical positioning of the hook 312 is substantially the same as that of the eye 314. As such, the eye 314 and hook 312, correspond to one another. The fastening system 300 also has a zipper 322. The zipper 322 includes a first zipper portion 322A which can be attached substantially vertically along the same edge of the front panel 201 to which the eye 314 is attached. In some embodiments, the first zipper portion 322A can be attached substantially vertically along the same edge of the front panel 201 to which the hook 312 is attached. The zipper 322 also includes a second zipper portion 322B, which may be attached substantially vertically along the same edge of the front panel to which the hook 312 is attached. in some embodiments, the second zipper portion 322B may also be attached substantially vertically along the same edge of the front panel 201 to which the eye 314 is attached. The hook 312 and eye 314 of the hook-and-eye attachment are located behind the zipper 320 of the recovery garment 100, such that the hook-and-eye attachment cannot be seen when the first and second zipper portions, 322A and 322B, are interlocked to secure the recovery garment 100 about the torso of the wearer. In some embodiments, the zipper 322 may be made of a transparent material allowing the hook-and-eye attachment to be visible from the front view of the wearer. The general arrangement of the hook-and-eye attachment within the zipper 322 is advantageous, because it allows the garment 100 to be pulled tighter about the torso of the wearer, using the zipper 322, after the hook 312 is engaged with the eye 314 making the hook-and-eye attachment. The hook-and-eye attachment are connected behind the zipper 322 and in front of a protective cloth layer 310 to protect the wearer's skin from irritation that may be caused by direct contact with the hook-and-eye attachment and/or with direct contact with the zipper. The protective cloth layer 310 may be made of the same fabric material as the recovery garment 100.

Within the interior of the recovery garment 100, and on an internal surface of one or both front panels 201, the recovery garment 100 has internal pockets 260 defined therein (see FIG. 2). These internal pockets 260 are advantageously accessible by the wearer, due to the stretchy, e.g., elastic, nature of the front panels 201. The internal pockets 260 are accessible without having to remove the recovery garment 100. As shown in FIG. 2, the respective inlet 262 by which each internal pocket 260 is able to be accessed is located adjacent an upper edge of each of the front panels 201, preferably between the attachment point 232 by which each loop 234 is attached to each of the front panels 201 and through which each strap 230 is attached to the front panel 201 and tightened to the shoulder of the wearer. It is advantageous for the inlet 262 of the internal pocket 260 to be spaced apart from the uppermost edge of the front panel to hide the inlet 262 from view when the recovery garment 100 is attached about the torso of the wearer. The internal pockets 260 are attached to the interior of the front panels 201 at a position to overlap the surgical site(s). The internal pockets 260 advantageously extend vertically down and laterally over to a position within the front panel 201 sufficient to ensure that the extent of the internal pocket 260 will coincide with the surgical site(s) on the wearer. In some embodiments, the internal pocket 260 can extend as far down the front panel as to coincide with the compression band 212 and as far laterally as where the front panel 201 transitions to the back panel 202, whether at a seam or not. In some embodiments, the internal pocket 260 may have an additional access point 264 where the front panels 201 transition to the back panel 202, whether at a seam or not. In some embodiments, the internal pocket 260 may have two access points of varying sizes. In some embodiments, the internal pocket may be made of the same fabric as the recovery garment 100.

The internal pockets 260 are configured to allow, for example, an ice pack to be placed over the surgical site to reduce post-operative swelling and/or for a breast prosthesis to be installed over the surgical site once it is no longer therapeutically necessary to apply an ice pack to the surgical site. As used herein, the term "ice pack" can be any therapeutic device which applies cold to, e.g., removes heat from, the surgical site. As used herein, the term breast prosthesis refers to a light-weight breast form, made of foam or fiberfill, which may be worn following a mastectomy. The ability to install a breast prosthesis within the internal pocket 260 after the application of an ice pack is no longer therapeutically necessary is advantageous because the use of such prostheses can complement the wearer's post-surgical physical appearance and allow the wearer to begin to return to a sense of normalcy by more closely resembling the pre-surgery appearance of the wearer before the wearer undergoes reconstructive surgery and allows for further healing to take place without the wearer feeling the need to rush into such reconstructive surgery, which can lead to increased risks of post-operative complications when reconstructive surgery is attempted close in time to, or simultaneous with, the mastectomy surgery.

The recovery garment 100 has an internal surface of one or both front panels 201, a drain loop strap 250, which is configured to hold a coiled drain tube, generally designated 460 (FIG. 5), therein to prevent the tubing from becoming entangled with anything else. The drain tube 460 is inserted at a first end thereof within the torso (e.g., under the armpit) of the wearer of the recovery garment 100 to allow for fluid to drain from the surgical site rather than accumulating within the torso of the patient during the healing process, thereby reducing post-operative complications due to, for example, infection. It is advantageous to have the drain tube 460 contained securely within the drain loop straps 250 of the garment so that the drain tube 460 will not become entangled with other objects in the surroundings of the wearer, or otherwise be exposed so as to be inadvertently pulled out from the surgical site, a very painful occurrence that requires the wearer to undergo further medical procedures to reinsert the drain tube 460 in the surgical site and which can also lead to increased incidents of complications for the wearer. The drain loop straps 250 sit on the lower portion of the front panels 201 and is made of a 2-inch elastic material and is attached with one singular button 252. In some embodiments, the drain loop straps 250 may be made of 1 to 2, 1.5 to 2.5, 2 to 3, 2.5 to 3.5 or 3 to 4 inch elastic material. The positioning of the drain loop straps 250 allows the drain tube 460 to be coiled and secured against the body of the wearer to limit the risk of drains being pulled or torn during everyday activities.

Figure 5:
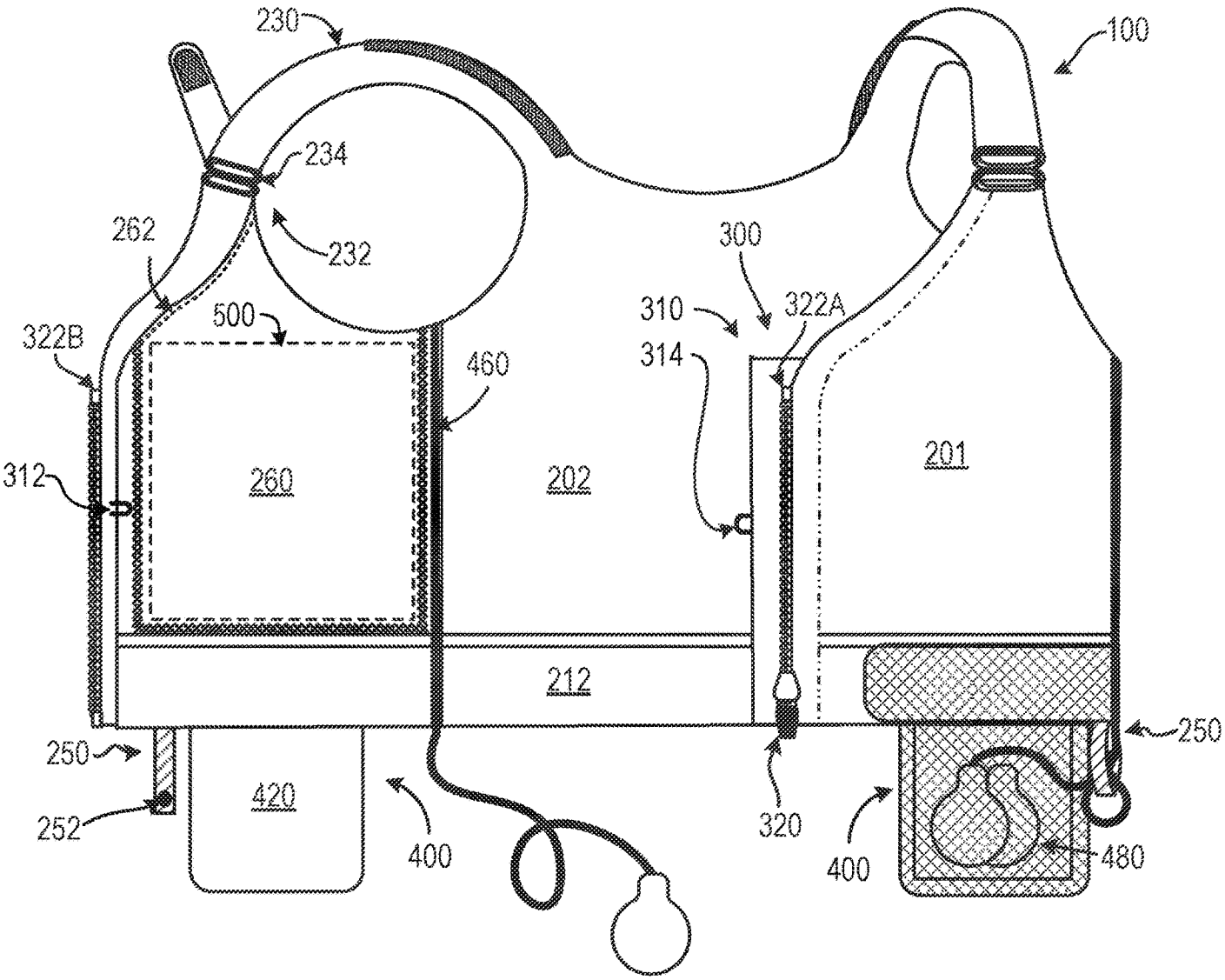
FIG. 5 is a partial internal view of the garment shown in FIG. 1, showing still further aspects of the garment.

The drain tube 460 can be any type of tubing made of a suitable material. A suitable material for the drain tube 460 may be a polymer (e.g., a plastic), or a different non-rigid, flexible material. In some embodiments, the drain tube 460 may be treated with a disinfectant or an antimicrobial additive. As shown in FIG. 5, the drain tube 460 is connected at a second end to a drainage device 480, which can be a suction bulb that can be squeezed to create a vacuum to promote fluid removal from the surgical site, and/or can be any other suitable device for promoting fluid removal from the surgical site within the torso of the wearer. Once connected to the drainage device 480, any excess drain tube 460 can be coiled up rather than being allowed to dangle between the point at which the first end of the drain tube 460 is attached to the torso of the wearer and the drainage device 480, this coiled up portion of drain tube 460 is placed within the drain loop strap 250.

The placement of the drain loop straps 250 is advantageous because it allows for easy manipulation of the drainage device 480 without detaching the drainage device 480 from the drain tube 460. As used herein, the term "adjacent to" can be defined as being formed in the front panel 201 to which the drain loop straps 250 are attached on a different surface thereof, but outside of an outer periphery of the internal pocket 260 of the same front panel 201. The drain loop straps 250 are made at least partially from a stretchable material (e.g., a material having a spandex, or elastomeric thread component) that will allow for easy insertion and removal of the coiled drain tube 460 by the wearer of the recovery garment 100, while also providing a comfortable contact surface against the skin of the wearer. The drain loop straps 250 are secured to the front panels 201, for example, by stitching and/or sewing, to ensure that the drain tube 460 is not easily ripped off of the recovery garment 100. As noted elsewhere herein, the drain loop straps 250 are particularly advantageous in limiting the exposure of the drain tube 460 to the outside environment, thereby preventing the drain tube 460 from becoming entangled with any objects in the immediate vicinity of the wearer of the recovery garment 100, thereby advantageously reducing the risk that the drain tube 460 will be caught, pulled, or torn away from the location where the drain tube 460 is fixedly attached (e.g., by surgical sutures) to the torso of the wearer of the recovery garment 100.

Drain pockets, generally designated 400, are removably attached to the recovery garment 100 in a position where a drainage device 480 can be held in place while remaining securely attached to the end of the drain tube 460. A drain pocket 400 may be attached to one or both front panels 201. In some embodiments there is one drain pocket 400. In some embodiments there are two front pockets 400. In the example embodiment shown in FIGS. 1-5, the drain pockets 400 are attached vertically at the bottom of each of the front panels 201 where the drain loop straps 250 are connected. The drain pockets 400 have a drain pocket front panel 410 and a drain pocket back panel 420, which can be made of the same or different fabrics. In some embodiments, the drain pocket front panel 410 is always made of a mesh material. In the example embodiment shown, the drain pocket front panel 410 is made of a mesh material, so that the amount and/or color of the fluid within the drainage device 480 can be visually determined without the drainage device 480 having to be removed from the drain pocket 400. This design is advantageous to avoid the risk of accidentally removing the drain tube 460 from the drainage device 480. In the same example embodiment shown, the drain pocket back panel 420 is made of a substantially solid material, which can be a stretchy and/or elastomeric material, which is contemplated as being more rugged than the mesh material of the drain pocket front panel 410. Alternatively, the drain pocket back panel 420 may be the same material as the drain pocket front panel 410 (e.g., a mesh material). In some embodiments, the drain pocket front and/or back panels 410, 420 may be made from a transparent or translucent plastic sheet. The drain pockets 400 have an opening, generally designated 440 (see FIG. 1), at the top when the drain pocket 400 is attached to the recovery garment 100, the opening 440 allowing for insertion and removal of the drainage device 480 from the drain pocket 400. In some embodiments, the opening 440 is open. In another embodiment, the opening 440 is configured to be closed, at least partially, for example using an elastic band contained and/or sewn within the portion of the fabric of the drain pocket 400 that defines the opening 440. In another embodiment, the opening 440 may be configured to be closed using a fabric with a tightening feature. Such a constricted opening 440 may be advantageous in that it can prevent accidental removal of the drainage device 480 from the pocket unless removed by the wearer and/or a medical professional providing post-operative care to the wearer. In some embodiments, an elastic band may be provided about the circumference of the opening 440 of the drain pockets 400 that can be deformed (e.g., expanded) to allow for removal or insertion of a drainage device 480 from or in the drain pocket 400, but which has a non-deformed size that is smaller than the drainage device 480 to more securely hold the drainage device within the drain pocket 400 and the drain tube 460 close to the subject's torso. In some embodiments, a drain pocket 400 can hold one, two, three, or four drainage devices 480. In some embodiments, a drain pocket 400 can hold one, two, or three drainage devices 480. Where one, two, three, or four drainage devices 480 are used, each drainage device 480 is securely attached to the end of a drain tube 460. Where there are one, two, three, or four drain tubes 460, each drain tube 460 can be secured by the drain tube strap 250 at one or both sides of the recovery garment 100.

The drain pockets 400 are, in the embodiment shown, attached to be accessible on the front of the recovery garment 100, but may be attached to the recovery garment 100 in any suitable position. The drainage pockets 400 are advantageously removably attachable to the garment 100, for example, at the bottom of the front panels 201 in the exemplary embodiment as illustrated in the accompanying figures. In the example embodiment shown, the drain pockets 400 are attachable at the front panels 201 by four snaps 430 (see FIG. 1), which can also be in the form of buttons or any other suitable type of attachment. In an embodiment, the drain pockets 400 are attachable at the compression band 212 by two, three, four, five, or six snaps or buttons. The snaps or buttons have the complementary snap or button connection point on the proximal side of the drain pockets 400 to the front panels 201. The use of snaps allows the drain pockets 400 to be removed from the recovery garment 100 and the recovery garment 100 to be worn without the drain pockets 400 after the drain tube 460 is removed from the surgical site, which will typically occur approximately 2 weeks after surgery in the case of a mastectomy. In the example embodiment shown, the drain pockets 400 are located on the front portion of the front panels 201. Depending on the type of drainage device 480 needed during post-operative care, the drain pockets 400 can be of any suitable size and are interchangeable with drain pockets 400 of any other size. In some embodiments, the recovery garment 100 can have two differently sized drain pockets 400 or same sized drain pockets 400 attached thereto. about 5 inches from the bottom of the bra. In some embodiments, the recovery garment 100 has the same sized drain pockets 400.

Figure 6:
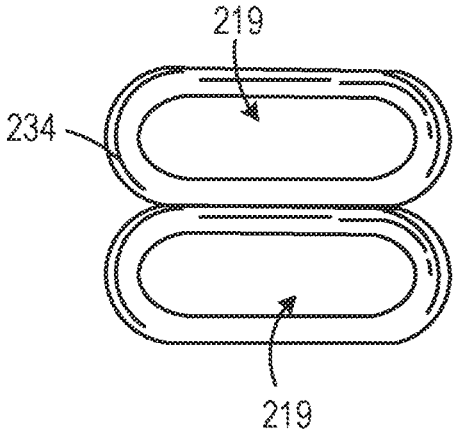
FIG. 6 is an isolated view of the strap loops used to secure and tighten the garment straps about the shoulders of the wearer.
Figure 7:
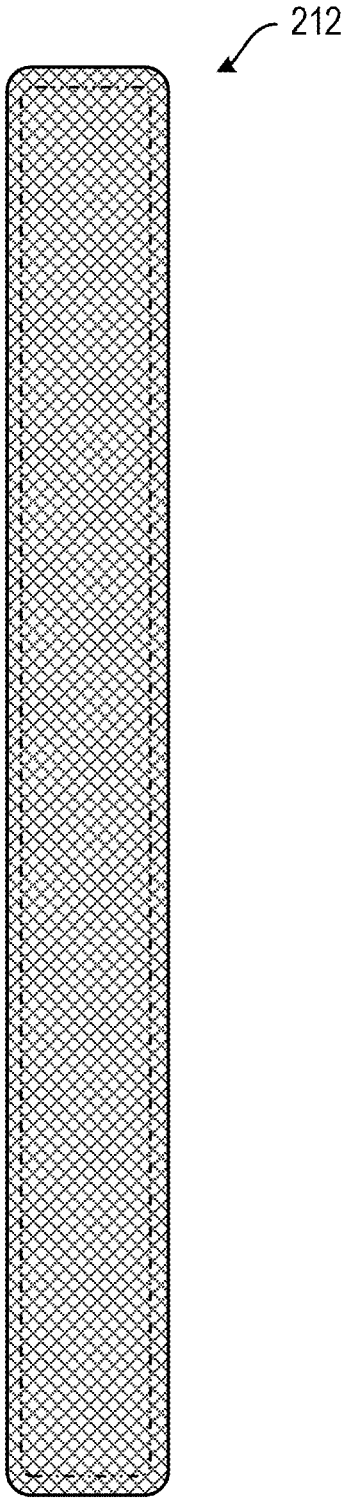
FIG. 7 is a rear view of the compression band.

FIG. 6 shows general shape of the loops 234 which serve as passages to the ends of the front-side of the straps 236 as shown in FIG. 1. The passages are generally designated 219, the loops are generally designated 234. FIG. 7 shows the general shape of the removable compression band 212.

EXEMPLARY EMBODIMENTS

Exemplary embodiments provided in accordance with the presently disclosed subject matter include, but are not limited to, the claims and the following embodiments:

Embodiment 1

A wearable garment for recovery of a wearer after the wearer has undergone a surgical procedure, the wearable garment comprising:

- a back panel and two front panels that, when the wearable garment is worn about a wearer;
- a fastening system configured to secure the outer edges of the two front panels together, wherein the fastening system comprises a hook-and-eye mechanism and a zipper, thereby securing the wearable garment about the wearer;
- a compression band configured to provide a compressive force about the wearer; and
- a drain loop strap attached to each of the two front panels for holding a drain tube against the wearer.

Embodiment 2

The wearable garment of embodiment 1, wherein the surgical procedure is a single mastectomy, a double mastectomy, a lumpectomy, a breast reconstruction, a breast augmentation, a breast lift, and/or a breast reduction.

Embodiment 3

The wearable garment of embodiments 1 or 2, wherein the back panel and two front panels comprise one continuous fabric.

Embodiment 4

The wearable garment of any one of embodiments 1-3, wherein the fastening system comprises a fabric overlay to protect the skin of the wearer from friction with the fastening system.

Embodiment 5

The wearable garment of any one of embodiments 1-4, wherein the fastening system comprises a protective cloth layer to protect the skin of the wearer from friction with the fastening system.

Embodiment 6

The wearable garment of any one of embodiments 1-5, comprising a drain pocket on each of the two front panels configured to hold at least one drainage device connected to a first end of the drain tube, wherein the at least one drainage device is configured to suction fluid from a surgical site of the wearer through the drain tube.

Embodiment 7

The wearable garment of any one of embodiments 1-6, wherein the drain loop strap is two inches long.

Embodiment 8

The wearable garment of embodiments 6 or 7, wherein at least a front panel of the drain pockets comprises a mesh material or a transparent material configured such that an amount and/or color of the fluid within the drainage device can be monitored without removing the drainage from the drain pocket.

Embodiment 9

The wearable garment of any one of embodiments 6-8, wherein the drain pockets are removably attached to the garment at the two front panels of the recovery garment.

Embodiment 10

The wearable garment of any one of embodiments 6-9, wherein the drain pockets are removably attached to each of the two front panels by snaps.

Embodiment 11

The wearable garment any one of embodiments 6-10, wherein the drain pockets are attached to each of the two front panels by four snaps.

Embodiment 12

The wearable garment of any one of embodiments 1-11, further comprising straps with an adjustable length secured about the shoulder of the wearer.

Embodiment 13

The wearable garment of any one of embodiments 1-12, wherein the wearable garment is configured to be worn about the torso of the wearer and, when one of the straps is disconnected from a front panel loop, an upper edge of the disconnected front panel is foldable in a downward direction to allow for inspection of a surgical site adjacent a breast of the wearer without removing the wearable garment from the torso of the wearer.

Embodiment 14

The wearable garment of any one of embodiments 1-13, wherein an amount of compression provided about the torso of the wearer by the straps is adjustable by adjusting the length of one or both straps.

Embodiment 15

The wearable garment of any one of embodiments 1-14, wherein each strap comprises a front-side of the strap which passes through a front panel loop connected on the top part of each front panel and a back-side of the strap which is continuous with the back panel of the wearable garment.

Embodiment 16

The wearable garment of any one of embodiments 1-15, wherein the front-side of the strap comprises an attachment surface and the back-side of the strap comprises a strap attachment configured to interlock to secure the strap on the wearer.

Embodiment 17

The wearable garment of any one of embodiments 1-16, wherein the back panel comprises an insertion point for the compression band comprising an elastomeric material, the compression band being a removable portion of the wearable garment.

Embodiment 18

The wearable garment of any one of embodiments 1-17, comprising an attachment surface on each external face of the two front panels and an attachment flap on each end of the compression band which wraps around the circumference of the wearable garment, wherein the attachment flaps are configured such that, when pulled towards the attachment surface of the two front panels, the compression band is stretched effectively tightening about the wearer, thereby increasing a magnitude of the compression force provided by the wearable garment.

Embodiment 19

The wearable garment of any one of embodiments 1-18, wherein the attachment surface comprises a hook-and-loop connection material and wherein the attachment flaps comprise the corresponding hook-and-loop connection material.

Embodiment 20

A wearable garment for recovery of a wearer after the wearer has undergone a surgical procedure, the wearable garment comprising:

- a back panel and two front panels that wherein the outer edges of the front panels are adjacent to each other when the wearable garment is work about a wearer;
- a fastening system configured to secure the outer edges of the front panels together, thereby securing the wearable garment about the wearer;
- a removable compression band configured to provide a compressive force about the wearer and comprising:
  - elastomeric material, wherein the compression band secures at bottom of the back panel through a fabric insertion point at either end of the back panel; and
  - an attachment flaps at either end of the compression band; and
  - wherein the attachment flaps are configured such that, when pulled towards the front panels of the wearable garment, the attachments plans connect to corresponding attachment surfaces at the bottom of each front panel, wherein the compression band can be variably stretched thereby increasing or decreasing a magnitude of the compression force provided at the compression region;
- straps configured to hold the wearable garment about the shoulders of the wearer;
- a drain loop strap for holding a drain tube in a coiled configuration against the wearer; and
- a drain pocket configured to hold at least one drainage device connected to a first end of the drain tube, wherein the drainage device is configured to suction fluid from a surgical site of the wearer through the drain tube.

Other embodiments of the current invention will be apparent to those skilled in the art from a consideration of this specification or practice of the invention disclosed herein. Thus, the foregoing specification is considered merely exemplary of the current invention with the true scope thereof being defined by the following claims.

What is claimed is:

1. A wearable garment for recovery of a wearer after the wearer has undergone a surgical procedure, the wearable garment comprising:

a back panel and two front panels adjacent to opposite sides of the back panel, wherein the back panel and the two front panels together form a continuously connected fabric, wherein each of the two front panels comprises an outer edge configured to abut the outer edge of the other front panel in use;

a fastening system configured to secure the outer edges of the two front panels together, a compression band comprising an elastic material, configured to provide a compressive force about the wearer; and an internal pocket on an internal surface of at least one of the two front panels, wherein the internal pocket has an access point where the front panel transitions to the back panel;

a drain loop strap attached to at least one of the two front panels configured to hold a drain tube against the wearer.

2. The wearable garment of claim 1, wherein the back panel and the two front panels comprise one continuous piece of fabric.

3. The wearable garment of claim 1, wherein the fastening system comprises a hook-and-eye mechanism and a zipper.

4. The wearable garment of claim 3, wherein the fastening system comprises a fabric overlay covering a bottom portion of the zipper, wherein the fabric overlay is configured to protect the wearer's skin from friction with the fastening system.

5. The wearable garment of claim 3, wherein the fastening system comprises a protective cloth layer configured to protect the wearer's skin from friction with the fastening system.

6. The wearable garment of claim 1, wherein the front panel internal pocket access point is at a seam between the front panel and the back panel.

7. The wearable garment of claim 1, wherein at least one of the front panels comprises a drain pocket, and each drain pocket is configured to hold at least one drainage device.

8. The wearable garment of claim 1, wherein each drain loop strap is two inches long.

9. The wearable garment of claim 7, wherein the drain pocket is removably attached to the at least one of the front panels of the wearable garment.

10. The wearable garment of claim 9, wherein the drain pocket is removably attached to the at least one of the front panels by one or more snaps.

11. The wearable garment of claim 1, further comprising a strap with an adjustable length configured to be secured about a shoulder of the wearer.

12. The wearable garment of claim 11, wherein the strap is integral with the back panel and adjustably attached to one of the front panels through a front panel loop, wherein the wearable garment is configured to be worn about a torso of the wearer, and wherein when the strap is disconnected from the front panel loop, an upper edge of the disconnected front panel is foldable in a downward direction to allow for inspection of a surgical site adjacent a breast of the wearer without removing the wearable garment from the torso of the wearer.

13. The wearable garment of claim 12, wherein the strap is configured to provide an amount of compression about the torso of the wearer that is adjustable by adjusting the length of the strap.

14. The wearable garment of claim 1, wherein the back panel comprises an insertion point for the compression band comprising the elastomeric material, the compression band being a removable portion of the wearable garment.

15. The wearable garment of claim 11, further comprising a front panel loop connected to a top portion of one of the front panels, wherein the strap is continuous with and extends from the back panel of the wearable garment, and wherein a first section of the strap is configured to pass through the front panel loop to secure the front panel to the back panel about the shoulder of the wearer.

16. The wearable garment of claim 15, wherein the first section of the strap comprises a first attachment surface and a second section of the strap that does not pass through the front panel loop comprises a second attachment surface, and wherein the first and second attachment surfaces are configured to interlock to secure the strap on the wearer.

17. The wearable garment of claim 1, wherein each front panel comprises an external face comprising an attachment surface, wherein the compression band comprises first and second ends, each of which comprises an attachment flap configured to interlock with the attachment surfaces, wherein the compression band extends from the attachment surface on one front panel, across the back panel, and to the attachment surface on the other front panel, wherein the compression band is configured to provide the compressive force about the wearer when the attachment flaps interlock with the attachment surfaces of the two front panels, and wherein a magnitude of the compressive force is adjustable by adjusting the placement of the attachment flaps on the attachment surfaces.

18. The wearable garment of claim 17, wherein the attachment surfaces comprise a hook-and-loop connection material and wherein the attachment flaps comprise a corresponding hook-and-loop connection material.

19. A wearable garment for recovery of a wearer after the wearer has undergone a surgical procedure, the wearable garment comprising:

a back panel and two front panels adjacent to opposite sides of the back panel, wherein the back panel and the two front panels together form a continuously connected fabric, wherein each of the two front panels comprises an outer edge configured to abut the outer edge of the other front panel in use;

a fastening system configured to secure the outer edges of the two front panels together;

a compression band comprising an elastic material, configured to provide a compressive force about a wearer;

an internal pocket on an internal surface of at least one of the two front panels, wherein the internal pocket has an access point where the front panel transitions to the back panel;

a drain loop strap attached to at least one of the two front from panels configured to hold a drain tube against the wearer;

a drain pocket configured to hold at least one drainage device, the drain pocket being removably attached to one of the front panels of the wearable recovery garment; and a strap with an adjustable length configured to be secured about a shoulder of the wearer.

20. The wearable garment of claim 19, further comprising a drain tube and a drainage device, wherein the drain tube comprises a first end configured to be inserted into the wearer's torso at a surgical site to allow fluid to drain from the surgical site through the drain tube and a second end connected to the drainage device, wherein the drainage device is positioned within one of the drain pockets, and wherein the drainage device is configured to suction fluid from the surgical site through the drain tube; wherein the drain pockets comprise a mesh material or a transparent material configured to allow monitoring of an amount and/or a color of a fluid within the drainage device in the drain pocket without removing the drainage device from the drain pocket.

* * * * *